US012612927B2

(12) United States Patent
Souverein et al.

(10) Patent No.: US 12,612,927 B2
(45) Date of Patent: Apr. 28, 2026

(54) GUIDE VANE ARRANGEMENT FOR USE IN A TURBINE

(71) Applicant: ArianeGroup GmbH, Taufkirchen (DE)

(72) Inventors: Louis Souverein, Riemerling (DE); Alessandro Cappiello, BB Delft (NL); Matteo Pini, AR Delft (NL)

(73) Assignee: ArianeGroup GmbH (DE)

( * ) Notice: Subject to any disclaimer, the term of this patent is extended or adjusted under 35 U.S.C. 154(b) by 0 days.

(21) Appl. No.: 19/246,282

(22) Filed: Jun. 23, 2025

(65) Prior Publication Data

US 2025/0389280 A1 Dec. 25, 2025

(30) Foreign Application Priority Data

Jun. 25, 2024 (EP) ..... 24184445

(51) Int. Cl.
*F04D 29/44* (2006.01)

(52) U.S. Cl.
CPC ..... *F04D 29/444* (2013.01)

(58) Field of Classification Search
CPC ..... F05D 2240/123; F05D 2270/17
See application file for complete search history.

(56) References Cited

U.S. PATENT DOCUMENTS 11,536,146 B2 * 12/2022 Souverein ..... F01D 9/041
2019/0345834 A1 11/2019 Souverein

FOREIGN PATENT DOCUMENTS

EP 3569817 A1 11/2019

OTHER PUBLICATIONS

Alessandro Cappiello, et al., "Draft: The Impact of Adjoint-Based Optimization of Supersonic Stators on Rocket Engines Turbine Stage Performance" Proceedings of ASME Turbo Expo 2024, Turbomachinery Technical Conference and Exposition GT2024, Jun. 24-28, 2024, London, United Kingdom, pp. 1-16.

* cited by examiner

*Primary Examiner* — Courtney D Heinle
*Assistant Examiner* — Danielle M. Christensen
(74) *Attorney, Agent, or Firm* — The Belles Group, P.C.

(57) ABSTRACT

A guide vane arrangement for use in a turbopump having a first guide vane and a second guide vane. The second guide vane is arranged adjacent to the first guide vane such that a flow channel is defined between a leading surface of the first guide vane and a trailing surface of the second guide vane. The trailing surface of the second guide vane has a trailing portion arranged adjacent to a trailing edge of the second guide vane and which is arranged at a first angle with respect to a trailing edge of the first guide vane and the trailing edge of the second guide vane, a leading portion which is arranged adjacent to a leading edge of the second guide vane and which is arranged at a second angle with respect to the trailing edge of the first guide vane and the trailing edge of the second guide vane, and an intermediate portion arranged between the trailing portion and the leading portion and which is arranged at a third angle. The second angle is larger than each of the first and third angles.

20 Claims, 7 Drawing Sheets

GUIDE VANE ARRANGEMENT FOR USE IN A TURBINE

CROSS-REFERENCES TO RELATED APPLICATIONS

This application claims the benefit of European patent application EP24184445 filed on Jun. 25, 2024, the entire disclosures of which are incorporated herein by way of reference.

FIELD OF THE INVENTION

The present disclosure relates to a guide vane arrangement for use in a turbine, a method of operating a guide vane arrangement, and a turbine comprising a guide vane arrangement.

BACKGROUND OF THE INVENTION

Turbines, such as, for example, turbines for use in turbo pumps typically are equipped with a guide vane arrangement or guide grid that is arranged upstream of a rotor of the turbine and serves to accelerate and deflect a fluid stream before the fluid stream is supplied to the rotor. In particular, the guide vane arrangement accelerates and deflects the fluid stream in such a manner that the fluid stream impinges on the rotor blades at an angle and at a flow speed that allows the rotor to operate at its design conditions.

Guide vane arrangements for use in turbo pump turbines may be produced in a multi-stage production process. In a first step, the guide vanes as well as a carrier component of the guide vane arrangement such as, for example, a tube body of a turbine manifold pipe or a turbine housing are cast or machined separately from one another. Thereafter, in a subsequent step, the individual components are welded to one another. Alternatively, it is also known that the guide vanes and the carrier component may be formed integrally with each other, for example in an additive manufacturing process, which can be more cost-effective. Such a guide vane arrangement is known from EP 3 569 817 A1. The cost-effective production process is entailed with a modified surface contour of the guide vanes which provides for a flow channel that does not correspond to that of an ideal shock-free nozzle using method of characteristics.

SUMMARY OF THE INVENTION

The present disclosure is directed to the object to specify a guide vane arrangement which can be produced in a simple and cost-effective manner with simultaneously providing enhanced fluid flow characteristics, in particular with respect to flow uniformity. Furthermore, the present disclosure is directed to the object to provide a method of operating a guide vane arrangement of this kind. Finally, the present disclosure is directed to the object to specify a turbine which is equipped with a guide vane arrangement of this kind.

This object is achieved by a guide vane arrangement having the features of claim 1, a method of operating a guide vane arrangement having the features of claim 12, and by a turbine having the features of claim 15.

According to an aspect, a guide vane arrangement is provided, in particular for use in a turbopump, which comprises a first guide vane and a second guide vane, wherein the second guide vane is arranged adjacent to the first guide vane such that a flow channel is defined between a leading surface of the first guide vane and a trailing surface of the second guide vane, wherein the flow channel is designed in such a manner that the fluid flow, when exiting the flow channel, flows at a desired first flow speed. The trailing surface of the second guide vane comprises a trailing portion which is arranged adjacent to a trailing edge of the second guide vane and which is arranged at a first angle with respect to a virtual plane defined by a trailing edge of the first guide vane and the trailing edge of the second guide vane, a leading portion which is arranged adjacent to a leading edge of the second guide vane and which is arranged at a second angle with respect to the virtual plane defined by the trailing edge of the first guide vane and the trailing edge of the second guide vane, and an intermediate portion which is arranged between the trailing portion and the leading portion and which is arranged at a third angle with respect to the virtual plane defined by the trailing edge of the first guide vane and the trailing edge of the second guide vane, wherein the second angle is larger than each of the first and third angles. The trailing surface between the intermediate portion and the trailing edge comprises at least one portion having a convex curvature.

The first and the second guide vane may have an identical shape. Thus, a guide vane which herein is designated as a "first guide vane" with respect to one adjacent "second guide vane" may also constitute a "second guide vane" with respect to another adjacent "first guide vane".

In some embodiments, the trailing portion of the trailing surface has a linear course. In other embodiments, the trailing portion of the trailing surface does not have a linear course. Thus, the first angle defined by the trailing portion and the virtual plane may vary along the trailing portion. In the case for a non-linear course of the trailing portion, the first angle may be an "average" first angle of the trailing portion. In particular, the first angle may be defined by a straight line through the two points at the beginning, i.e. the upstream end, and the end, i.e. the downstream end, which is the trailing edge, of the trailing portion, respectively, and the virtual plane. The beginning of the trailing portion may be the downstream end of the intermediate portion. In the alternative, the beginning of the trailing portion may be the downstream end of a first transition portion between the intermediate portion and the trailing portion. As a further alternative, the beginning of the trailing portion may be the downstream end of a second transition portion between the intermediate portion and the trailing portion. The downstream end of the intermediate portion and/or the first transition portion and/or the second transition portion may be defined by an abrupt change of the slope of the trailing surface, for example in case the intermediate portion and/or the first transition portion and/or the second transition portion have/has a linear course. In the alternative, the downstream end of the intermediate portion and/or the first transition portion and/or the second transition portion may be defined by an inflection point in the course of the trailing surface, for example in case the intermediate portion and/or the first transition portion and/or the second transition portion have/has a non-linear course.

In the case for a non-linear course of the overall trailing portion, and if a portion of the trailing portion directly adjacent the trailing edge has a linear course or approximately linear course, the first angle may be the angle between the linear portion and the virtual plane defined by the trailing edge of the first guide vane and the second guide vane.

The first angle defined by the trailing portion and the virtual plane may be selected such that a fluid flow flowing through the flow channel is controlled in such a manner that the fluid flow exits the flow channel at a desired flow angle with respect to the virtual plane. The first angle defined by the trailing portion and the virtual plane substantially may correspond to the desired flow angle that the fluid flow, upon exiting the flow channel, defines with the virtual plane.

In some embodiments, the leading portion of the trailing surface has a linear course. In other embodiments, the leading portion of the trailing surface does not have a linear course. Thus, the second angle defined by the leading portion and the virtual plane may vary along the leading portion. In the case for a non-linear course of the leading portion, the second angle may be an "average" second angle of the leading portion. In particular, the second angle may be defined by a straight line through the two points at the beginning, i.e. the upstream end, and the end, i.e. the downstream end, of the leading portion, respectively, and the virtual plane. The beginning of the leading portion may be the leading edge of the second guide vane. The end of the leading portion may be an inflection point of a curvature, in particular a convex curvature, adjacent to an upstream end of the intermediate portion or a third transition portion between the leading portion and the intermediate portion.

The second angle of the leading portion of the trailing surface with respect to the virtual plane is larger than the first angle. Thus, after entering the flow channel, the fluid flow flows along the leading portion and thereby may be deflected so as to define a flow angle with the virtual plane that is larger than the desired flow angle of the fluid flow upon exiting the flow channel.

In some embodiments, the intermediate portion of the trailing surface has a linear course. In other embodiments, the intermediate portion of the trailing surface does not have a linear course. Thus, the third angle defined by the intermediate portion and the virtual plane may vary along the intermediate portion. In the case for a non-linear course of the intermediate portion, the third angle may be an "average" third angle of the intermediate portion. In particular, the third angle may be defined by a straight line through the two points at the beginning, i.e. the upstream end, and the end, i.e. the downstream end, of the intermediate portion, respectively, and the virtual plane. The third angle is smaller than the second angle. The upstream end may be the downstream end of the leading portion or of a third transition portion. The downstream end of the third transition portion may be defined by an inflection point of a curvature, in particular a convex curvature, of the third transition portion adjacent to the intermediate portion.

Thus, the leading portion has a relatively steep course, in particular large slope, compared to the intermediate portion and the leading portion, which makes redundant a support structure for the leading portion during an additive manufacturing process of the guide vane. In particular, prior art guide vanes with a more flattish leading portion require the use of a support structure during an additive manufacturing process, which may be difficult to remove after the additive manufacturing process, due to the rather small cross-section of the flow channel formed with the leading surface of an opposite guide vane. In addition, the relatively steep course of the leading portion of the guide vane arrangement of the present disclosure may provide for a good accessibility of the leading portion, for example in order to provide surface finishing to the leading portion. As a result, the guide vane arrangement may be produced in a cost-efficient manner, for example by means of an additive manufacturing process.

For example, the second angle may be larger than 25°, in particular larger than 30°, in particular larger than 35°, in particular in a range of 50° to 70°, preferably in the range of 55° to 65° and in particular approximately 60°. The first angle may be in the range of 10° to 35° or 15° to 35°, preferably in the range of 20° to 30° and in particular approximately 25°. The third angle may be in a range of 0° to 25°, for example 1° to 15° or 5 to 20°, preferably in the range of 7° to 20° and in particular approximately 10°.

The guide vane arrangement may be made of or comprise any kind of material which meets the specific requirements of a guide vane arrangement (hardness, temperature resistance etc.). The guide vane arrangement may be composed of metal, in particular titanium or a titanium or a nickel alloy. The guide vane arrangement may also be made of or comprise other metallic materials, such as for example aluminum or steel alloys. The guide vanes of the guide vane arrangement may be also made of or comprise a ceramic or plastic material.

In the present disclosure, a surface portion with a convex-shaped curvature is a surface portion that protrudes into the adjoining flow channel, and a surface portion with a concave-shaped curvature is a surface portion that protrudes away from the adjoining flow channel. Or, in other words, the points of a convex-shaped surface portion are located "above" a tangent to a point of the convex-shaped portion, if the flow channel is considered to be located "below" the respective tangent. Or, the points of a convex-shaped surface portion are located "above" a tangent to each of the points of the convex-shaped portion, if the flow channel is considered to be located "below" the respective tangent. Analogously, the points of a concave-shaped surface portion are located "below" a tangent to a point of the concave-shaped portion, if the flow channel is considered to be located "below" the respective tangent. Or, the points of a concave-shaped surface portion are located "above" a tangent to each of the points of the concave-shaped surface portion, if the flow channel is considered to be located "below" the respective tangent.

The at least one convex-shaped portion of the trailing surface between the intermediate portion and the trailing edge is a portion of the trailing surface that protrudes into the flow channel defined by the first and second guide vanes. The at least one convex-shaped portion may be exactly two convex portions. Between the two convex-shaped portions, a concave-shaped portion may be provided. The curvature of the at least one convex-shaped portion may have a curvature that is adapted to keep the fluid flow parallel to the trailing surface wall while enabling at the same time attenuating shock waves generated by the wall and/or avoiding the generation of new shocks and/or avoiding the reflection of characteristic waves or shocks. This may be beneficial with regard to flow uniformity at the outlet of the guide vane arrangement.

In an implementation, the trailing surface of the second guide vane may comprise a first transition portion between the intermediate portion and the trailing portion which defines a recompression portion of the flow channel which has a flow cross-section that decreases in the flow direction of the fluid flow flowing through the flow channel, and wherein the recompression portion is designed in such a manner that the fluid flow, upon flowing through the recompression portion, is decelerated to a second flow speed, and wherein, optionally, the first transition portion comprises a first concave curvature. The first transition portion may also have a linear or substantially linear course. The first transition portion may comprise any course adapted to decrease the flow cross-section.

In a further implementation, the trailing surface of the second guide vane may comprise a second transition portion between the intermediate portion and the trailing portion which comprises a first convex curvature, wherein, optionally, the second transition portion defines an additional expansion portion of the flow channel which has a flow cross-section that increases in the flow direction of the fluid flow flowing through the flow channel, and wherein, optionally, the additional expansion portion is designed in such a manner that the fluid flow, upon flowing through the expansion portion, is accelerated to a third flow speed. Thus, in the further implementation comprising the first convex curvature, the first convex curvature of the second transition portion is one portion of the at least one portion between the intermediate portion and the trailing edge having a convex curvature. The convex curvature may provide for an additional expansion of the fluid flow before exiting the flow channel.

In an aspect of the further implementation, the first transition portion may be arranged between the intermediate portion and the second transition portion, and, optionally, the third flow speed may approximately correspond to the desired first flow speed and/or may be higher than the second flow speed. Thus, in this aspect, the second transition portion may provide for an additional expansion of the fluid flow after the recompression in the recompression portion. The additional expansion may be adapted to cancel or weaken shock waves propagating in the flow channel. The second transition portion may be designed to accelerate the fluid flow, in particular to a flow speed corresponding to the desired first flow speed.

In an embodiment, the trailing portion of the trailing surface of the second guide vane may comprise a second convex curvature. Thus, in the embodiment comprising the second convex curvature, the second convex curvature of the trailing portion is one portion of the at least one portion between the intermediate portion and the trailing edge having a convex curvature. The second convex curvature may be designed to keep the fluid flow parallel to the trailing surface wall so as to avoid the appearance of shock waves at the exit of the flow channel or at least weakening appearing shock waves.

In an embodiment comprising a trailing surface with the first and second convex curvatures, the trailing portion of the trailing surface of the second guide vane may comprise a second concave curvature between the first and second convex curvatures. Thus, the second concave curvature may define a transition from the first convex curvature to the second convex curvature.

In a further embodiment, the leading portion of the second guide vane may have a leading portion curvature with an inflection point where a concave curvature passes over in a convex curvature, and wherein the concave curvature is provided upstream of the convex curvature. The specific design of the leading portion may be adapted to have an impact on the position of the sonic line. The specific design of the leading portion, in particular the convex curvature, may be designed to affect the flow characteristics upstream of the recompression portion, and thus to indirectly also affect the effects of the recompression portion on the fluid flow.

In a modification, the trailing surface of the second guide vane may comprise a third transition portion between the leading portion and the intermediate portion, wherein the third transition portion may comprise a third convex curvature, and wherein the third transition portion and the outlet portion of the leading surface of the first guide vane may define an expansion portion of the flow channel which has a flow cross-section that increases in the flow direction of the fluid flow flowing through the flow channel, and wherein the expansion portion may be designed in such a manner that the fluid flow, upon flowing through the expansion portion, is accelerated to a fourth flow speed, and wherein, optionally, the fourth flow speed may be higher than the desired first flow speed. Thus, in the modification where the fourth flow speed is higher than the desired first flow speed, the expansion portion provides for an over-expansion of the fluid flow. The third transition portion may define a nozzle throat. In particular, the convex curvature may define a nozzle throat. In the modification where the leading portion of the second guide vane may have a curvature with an inflection point where a concave curvature passes over in a convex curvature, and wherein the concave curvature is provided upstream of the convex curvature, and where the trailing surface of the second guide vane comprises the third transition portion with the third convex curvature, the third convex curvature may transition into the convex curvature of the leading portion curvature, or the third convex curvature may be the convex curvature of the leading portion curvature. In the last alternative, the third transition portion may be defined by the convex curvature of the leading portion curvature.

In a further modification, the third angle of the intermediate portion may be smaller than the first angle of the trailing portion. Thus, upon flowing along the intermediate portion, the fluid flow may be deflected so as to define a flow angle with the virtual plane that is smaller than the desired flow angle of the fluid flow upon exiting the flow channel.

In other modifications, the leading surface of the first guide vane may comprise at least one of an inlet portion which is arranged adjacent to a leading edge of the first guide vane and which, with respect to the flow channel, is arranged opposite to the leading portion of the trailing surface of the second guide vane, wherein, optionally, the inlet portion of the leading surface of the first guide vane and the leading portion of the trailing surface of the second guide vane may define a restricting portion of the flow channel which has a flow cross-section that decreases in a flow direction of the fluid flow flowing through the flow channel, and an outlet portion which is arranged adjacent to a trailing edge of the first guide vane, wherein, optionally, a projection of the leading portion of the trailing surface of the second guide vane into the virtual plane at least partially coincides with a projection of the outlet portion of the leading surface of the first guide vane into the virtual plane.

In an implementation of the other modifications, a projection of the intermediate portion and/or of the trailing portion of the trailing surface of the second guide vane into the virtual plane may not coincide with the projection of outlet portion of the leading surface of the first guide vane into the virtual plane.

The increased angle of the leading portion with respect to the virtual plane requires the presence of the intermediate portion that extends at an angle with respect to the virtual plane that is even lower than the angle defined between the trailing portion and the virtual plane. However, the above design of the second guide vane ensures that, when viewed from a direction of the trailing edges of the guide vanes, the intermediate portion and/or the trailing portion of the trailing surface of the second guide vane is/are not covered by the outlet portion of the leading surface of the first guide vane and hence are easily accessible, for example for providing surface finishing or for removing a support structure which is built up during additive manufacturing of the guide vane arrangement for supporting the intermediate portion and/or the trailing portion.

According to a further aspect, a method of operating a guide vane arrangement is provided, which comprises supplying a fluid flow to a flow channel defined between a leading surface of a first guide vane and a trailing surface of a second guide vane, and guiding the fluid flow along a trailing portion of the trailing surface of the second guide vane which is arranged adjacent to a trailing edge of the second guide vane and thereby deflecting the fluid flow such that the fluid flow exits the flow channel at a first flow angle with respect to a virtual plane defined by a trailing edge of the first guide vane and the trailing edge of the second guide vane and with a desired first flow speed, wherein the fluid flow, prior to being guided along the trailing portion of the trailing surface, is guided along a leading portion of the trailing surface of the second guide vane which is arranged adjacent to a leading edge of the second guide vane and thereby deflected such that the fluid flow flows at a second flow angle with respect to the virtual plane defined by the trailing edge of the first guide vane and the trailing edge of the second guide vane, and thereafter is guided along an intermediate portion of the trailing surface of the second guide vane which is arranged between the trailing portion and the leading portion and thereby deflected such that the fluid flow flows at a third flow angle with respect to the virtual plane defined by the trailing edge of the first guide vane and the trailing edge of the second guide vane, wherein the second flow angle is larger than each of the third flow angle and the first flow angle, and thereafter is guided along a first transition portion of the trailing surface of the second guide vane which is arranged between the intermediate portion and the trailing portion and which defines a recompression portion of the flow channel which has a flow cross-section that decreases in the flow direction of the fluid flow flowing through the flow channel, and wherein the recompression portion is designed in such a manner that the fluid flow, upon flowing through the recompression portion, is decelerated to a second flow speed, and thereafter is guided along a second transition portion of the trailing surface of the second guide vane which is arranged between the first transition portion and the trailing portion and which defines an additional expansion portion of the flow channel which has a flow cross-section that increases in the flow direction of the fluid flow flowing through the flow channel, and wherein the additional expansion portion is designed in such a manner that the fluid flow, upon flowing through the additional expansion portion, is accelerated to a third flow speed, wherein, optionally, the third flow speed approximately corresponds to the desired first flow speed. Thus, a method is provided where the fluid flow is subject to a recompression followed by an additional expansion.

In an implementation of the method, the fluid flow, prior to being guided along the trailing portion of the trailing surface, may be guided along a third transition portion of the trailing surface of the second guide vane which is arranged between the leading portion and the intermediate portion, wherein the third transition portion and an outlet portion of the leading surface of the first guide vane may define an expansion portion of the flow channel which has a flow cross-section that increases in the flow direction of the fluid flow flowing through the flow channel, and wherein the expansion portion may be designed in such a manner that the fluid flow, upon flowing through the expansion portion, is accelerated to a fourth flow speed, and wherein, optionally, the fourth flow speed may be higher than the desired first flow speed.

The third transition portion may define, together with the outlet portion of the leading surface of the first guide vane, a throat of the guide vane arrangement where the flow channel has the smallest cross-section. Thus, in the implementation of the method, the fluid flow may be subject to an expansion followed by a recompression and an additional expansion.

In a further implementation, the method may comprise at least one of the following features. The first transition portion of the trailing surface of the second guide vane may comprises a first concave curvature, the second transition portion of the trailing surface of the second guide vane may comprises a first convex curvature, the trailing portion of the trailing surface of the second guide vane may comprises a second convex curvature, the third transition portion of the trailing surface of the second guide vane may comprise a third convex curvature, the trailing portion of the trailing surface of the second guide vane may comprise a second concave curvature between the first and second convex curvatures, and the leading portion may comprise a leading portion curvature with a convex curvature downstream a concave curvature.

The present disclosure also provides a turbine, in particular for use in a turbo pump, which comprises a guide vane arrangement according to one or more of the aspects, implementations, embodiments etc. disclosed above.

BRIEF DESCRIPTION OF THE DRAWINGS

Further details, advantages and aspects of the present disclosure will become apparent from the following embodiment taken in conjunction with the drawings, wherein.

DETAILED DESCRIPTION OF PREFERRED EMBODIMENTS

In the present disclosure, a surface portion with a convex-shaped curvature is a surface portion that protrudes into the adjoining flow channel (relative to the surface portion(s) adjoining the surface portion with the convex-shaped curvature), and a surface portion with a concave-shaped curvature is a surface portion that protrudes away from the adjoining flow channel (relative to the surface portion(s) adjoining the surface portion with the concave-shaped curvature). Or, in other words, the points of a convex-shaped surface portion are located "above" a tangent to a point of the convex-shaped portion, if the flow channel is considered to be located "below" the respective tangent. Or, the points of a convex-shaped surface portion are located "above" a tangent to each of the points of the convex-shaped portion, if the flow channel is considered to be located "below" the respective tangent. Thus, the points of a convex-shaped surface portion of a guide vane surface adjoining a flow channel may be considered to be located on an opposite side of a tangent to a point of the convex-shaped portion to the side where the flow channel is located. Analogously, the points of a concave-shaped surface portion are located "below" a tangent to a point of the concave-shaped portion, if the flow channel is considered to be located "below" the respective tangent. Or, the points of a concave-shaped surface portion are located "above" a tangent to each of the points of the concave-shaped surface portion, if the flow channel is considered to be located "below" the respective tangent. Thus, the points of a concave-shaped surface portion of a guide vane surface adjoining a flow channel may be considered to be located on a same side of a tangent to a point of the concave-shaped surface portion as the side where the flow channel is located.

Figure 1:
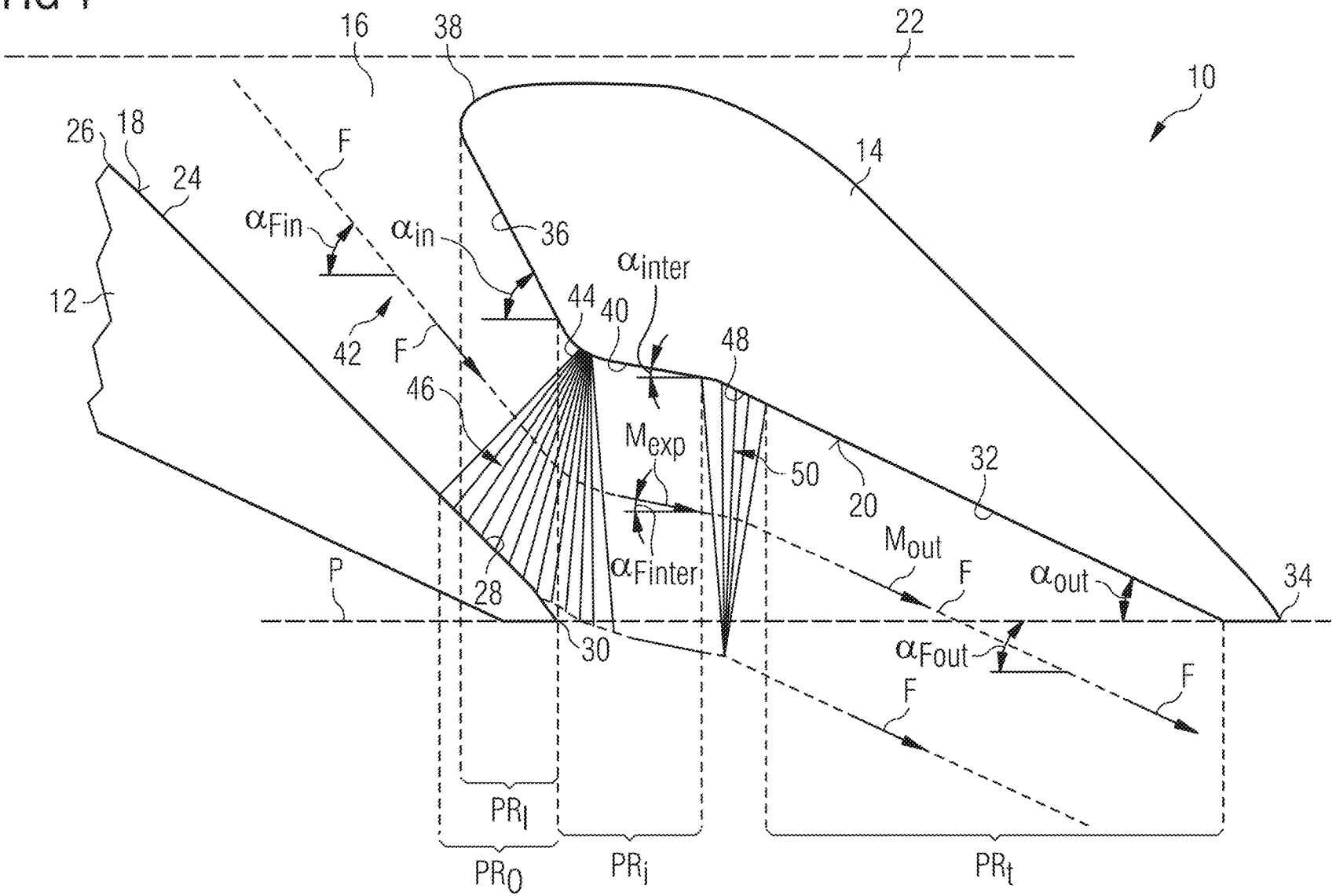
FIG. 1 schematically shows a guide vane arrangement according to the prior art.

FIG. 1 shows only a single first guide vane 12 and only a single second guide vane 14 of a guide vane arrangement 10 according to the prior art. The guide vane arrangement 10 corresponds to the guide vane arrangement of European patent application publication 3 569 817, the disclosure of which is hereby incorporated by reference. In particular, FIG. 1 shows a longitudinal cross-sectional view of each of the first and second guide vanes 12, 14. The guide vane arrangement 10, however, is provided with a plurality of first and second guide vanes 12, 14 which are arranged adjacent to each other so as to define a plurality of flow channels 16. The first and second guide vanes 12, 14 of the guide vane arrangement 10 are identically shaped and dimensioned. Thus, the guide vane which in the arrangement of FIG. 1 constitutes the first guide vane 12 with respect to the second guide vane 14 arranged on the right-hand side of the first guide vane 12 constitutes with respect to another guide vane arranged on the left-hand side of the first guide vane 12 (not shown in FIG. 1) a second guide vane.

The first and the second guide vanes 12, 14 are formed integral with each other and with a carrier structure 22 which in FIG. 1 is schematically indicated by a dotted line. The carrier structure 22 may, for example, be designed in the form of a rotation-symmetric turbine manifold and/or turbine housing to which the individual first and second guide vanes 12, 14 of the guide vane arrangement 10 are attached so as to define a guide grid for the fluid flow F to be supplied to a rotor having a plurality of rotor blades to be rotatably installed in a turbine downstream of the guide vane arrangement 10. The first and second guide vanes 12, 14 are stationary mounted in the turbine manifold and/or turbine housing so as to form a stator upstream the rotor.

A leading surface 18 of the first guide vane 12 comprises an inlet portion 24 which is arranged adjacent to a leading edge 26 of the first guide vane 12 and an outlet portion 28 which is arranged adjacent to a trailing edge 30 of the first guide vane 12. The trailing surface 20 of the second guide vane 14 which, together with the leading surface 18 of the first guide vane 12, defines the flow channel 16, comprises a trailing portion 32 arranged adjacent to a trailing edge 34 of the second guide vane 14, a leading portion 36 arranged adjacent to a leading edge 38 of the second guide vane 14 and an intermediate portion 40 arranged between the trailing portion 32 and the leading portion 36.

The inlet portion 24 of the leading surface 18 of the first guide vane 12, with respect to the flow channel 16, is arranged opposite to the leading portion 36 of the trailing surface 20 of the second guide vane 14 and, together with the leading portion 36 of the trailing surface 20 of the second guide vane 14, defines a restricting portion 42 of the flow channel 16. The restricting portion 42 of the flow channel 16 has a flow cross-section that decreases in a flow direction of the fluid flow F flowing through the flow channel 16. Thus, the fluid flow F, upon being guided through the restricting portion 42, is accelerated, i.e. when exiting the restricting portion 42 the fluid flow F has a flow speed that is higher than the flow speed of the fluid flow F upon entering the flow channel 16 in the region of the leading edges 26, 38 of the first and the second guide vane 12, 14.

As becomes apparent from FIG. 1, the trailing portion 32 of the trailing surface 20 of the second guide vane 14 extends at a first angle $\alpha_{out}$ with respect to a virtual plane P defined by the trailing edges 30, 34 of the first and the second guide vanes 12, 14. In particular, the virtual plane P is a plane which is spanned by the trailing edges 30, 34 of the first and second guide vanes 12, 14. During operation of the guide vane arrangement 10, the fluid flow F is guided along the trailing portion 32 and thereby is deflected such that the fluid flow F exits the flow channel 16 at a first flow angle $\alpha_{Fout}$ with respect to the virtual plane P which substantially corresponds to the first angle $\alpha_{out}$.

The leading portion 36 of the trailing surface 20 of the second guide vane 14 extends at a second angle $\alpha_{in}$ with respect to the virtual plane P defined by the trailing edges 30, 34 of the first and the second guide vanes 12, 14. During operation of the guide vane arrangement 10, the fluid flow F, prior to being guided along the trailing portion 32, is guided along the leading portion 36 and thereby deflected such that the fluid flow F, in the region of the leading portion 36 flows at a second flow angle $\alpha_{Fin}$ with respect to the virtual plane P which substantially corresponds to the second angle $\alpha_{in}$.

The intermediate portion 40 of the trailing surface 20 of the second guide vane 14 extends at a third angle $\alpha_{inter}$ with respect to the virtual plane P defined by the trailing edges 30, 34 of the first and the second guide vanes 12, 14. During operation of the guide vane arrangement 10, the fluid flow F is guided along the intermediate portion 40 and thereby deflected such that the fluid flow F, in the region of the intermediate portion 40 flows at a third flow angle $\alpha_{Finter}$ with respect to the virtual plane P which substantially corresponds to the third angle $\alpha_{inter}$.

The second angle $\alpha_{in}$ is larger than the first angle $\alpha_{out}$ and the third angle $\alpha_{inter}$ is smaller than the first angle $\alpha_{out}$. Similarly, the second flow angle $\alpha_{Fin}$ is larger than the first flow angle $\alpha_{Fout}$ and the third flow angle $\alpha_{Finter}$ is smaller than the first flow angle $\alpha_{Fout}$. In the exemplary embodiment of a guide vane arrangement 10 depicted in FIG. 1, the first angle $\alpha_{out}$ and the first flow angle $\alpha_{Fout}$ are approximately 25°, the second angle $\alpha_{in}$ and the second flow angle $\alpha_{Fin}$ are approximately 60°, and the third angle $\alpha_{inter}$ and third flow angle $\alpha_{Finter}$ are approximately 10°.

Further, the first and second guide vanes 12, 14 are designed and arranged relative to each other such that a projection $PR_1$ of the leading portion 36 of the trailing surface 20 of the second guide vane 14 into the virtual plane P substantially coincides with a projection $PR_o$ of the outlet portion 28 of the leading surface 18 of the first guide vane 12 into the virtual plane P, whereas projections $PR_i$, $PR_t$ of the intermediate portion 40 and the trailing portion 32 of the trailing surface 20 of the second guide vane 14 into the virtual plane P do not coincide with the projection of the outlet portion 28 of the leading surface 18 of the first guide vane 12 into the virtual plane P. Thus, when viewed from a direction of the trailing edges 30, 34 of the guide vanes 12, 14, only the leading portion 36 of the trailing surface 20 of the second guide vane 14 is covered by the outlet portion 28 of the leading surface 18 of the first guide vane 14, whereas the intermediate portion 40 and the trailing portion 32 of the trailing surface 20 of the second guide vane 14 are freely accessible.

The trailing surface 20 of the second guide vane 14 is provided with a first transition portion 48 which is arranged between the intermediate portion 40 and the trailing portion 32 and which has a concave curvature. The guide vane arrangement 10 may also be designed with a gradual curve extending along the whole length of the trailing surface 20 between 44 and the trailing edge 34. In that case, portions 40 and 32 will collapse to a point, and angles $\alpha_{inter}$ and $\alpha_{out}$ define the wall inclination at the start and the end of first transition portion 48.

The first transition portion 48 defines a recompression portion 50 which has a flow cross-section that decreases in the flow direction of the fluid flow F flowing through the fluid channel 16. The recompression portion 50 is designed in such a manner that the fluid flow F, upon flowing through the recompression portion 50, is decelerated to a desired first flow speed $M_{out}$ of the fluid flow exiting the flow channel 16.

Finally, the trailing surface 20 of the second guide vane 14 is provided with a second transition portion 44. The second transition portion 44 is arranged between the leading portion 36 and the intermediate portion 40 and, with respect to the flow channel 16, arranged opposite to the outlet portion 28 of the leading surface 18 of the first guide vane 12. The second transition portion 44 has a convex curvature. The second transition portion 44 and the outlet portion 28 of the leading surface 18 of the first guide vane 12 define an expansion portion 46 of the flow channel 16 which has a flow cross-section that increases in the flow direction of the fluid flow F.

The flow channel 16 in general has a design which ensures that the fluid flow F, upon exiting the flow channel 16, flows at a desired first flow speed $M_{out}$. The expansion portion 46, however, is designed in such a manner that the fluid flow F, upon flowing the expansion portion 46, is accelerated to a second flow speed $M_{exp}$ that is higher than the desired first flow speed $M_{out}$. In other words, the expansion portion 46 provides for an over-expansion of the fluid flow F, and the recompression portion 50 provides for a compensation of the over-expansion of the fluid flow F in the expansion portion 46.

During operation of the guide vane arrangement 10, the restriction portion 42, the expansion portion 46 and the recompression portion 50 control the flow speed of the fluid flow F so as to ensure that the fluid flow F exits the flow channel 16 at the desired first flow speed $M_{out}$. At the same time, the design of the guide vanes 12, 14 allows manufacturing of the guide vane arrangement 10 by means of an additive manufacturing process. In particular, the second angle $\alpha_{in}$, which in the exemplary embodiment of a guide vane arrangement 10 shown in FIG. 1 is approximately 60°, allows manufacturing of the leading portion 36 of the trailing surface 20 of the second guide vane 14 by an additive manufacturing process without being supported by support structures. Thus, a step of removing support structures which, due to the coverage of the leading portion 36 of the trailing surface 20 of the second guide vane 14 by the outlet portion 28 of leading surface 18 of the first guide vane 12, is difficult to access can be dispensed with.

To the contrary, upon layer-wise built up of the guide vane arrangement 10 in an additive manufacturing process, at least the low-angled intermediate portion 40 and, if necessary, also the trailing portion 32 of the trailing surface 20 of the second guide vane 14 are supported by a removable supporting structure S. The supporting structure S, however, is easy to remove after completion of the layer-wise built up of the guide vane arrangement 10, since the design of the guide vane arrangement 10 allows an unhindered access to the intermediate portion 40 and the trailing portion 32 of the trailing surface 20 of the second guide vane 14. By means of additive manufacturing, the carrier structure 22 and the guide vanes 12, 14 can be manufactured in one piece.

The guide vane arrangement 10 according to the prior art as depicted in FIG. 1 is suitable for use in supersonic turbines, and using the same basic principle (adjusting the contour along the trailing surface 20 to obtain an average design flow speed and average design angle at the outlet plane P, defined by trailing edges 30 and 34) can be applied for subsonic turbines as well.

It has turned out that the profile of the prior art guide vane arrangement 10 depicted in FIG. 1 in an exemplary manner comprising the expansion portion 46 and the recompression portion 50 may lead to shock waves in the fluid flow F and reflected expansion waves and thus to a severely non-uniform flow at the outlet of the guide vane arrangement 10. This may lead to a strong unsteady interaction between the guide vane arrangement and rotor blades of a rotor downstream the guide vane arrangement 10, a large fluctuation of power output, aerodynamic forces and moment exerted on the rotor blades and pressure jumps on the rotor blades. All these characteristics may lead to high cycle fatigue problems and thus to a reduced lifetime of the rotor as well as to high flow losses resulting in a reduced efficiency.

Figure 2:
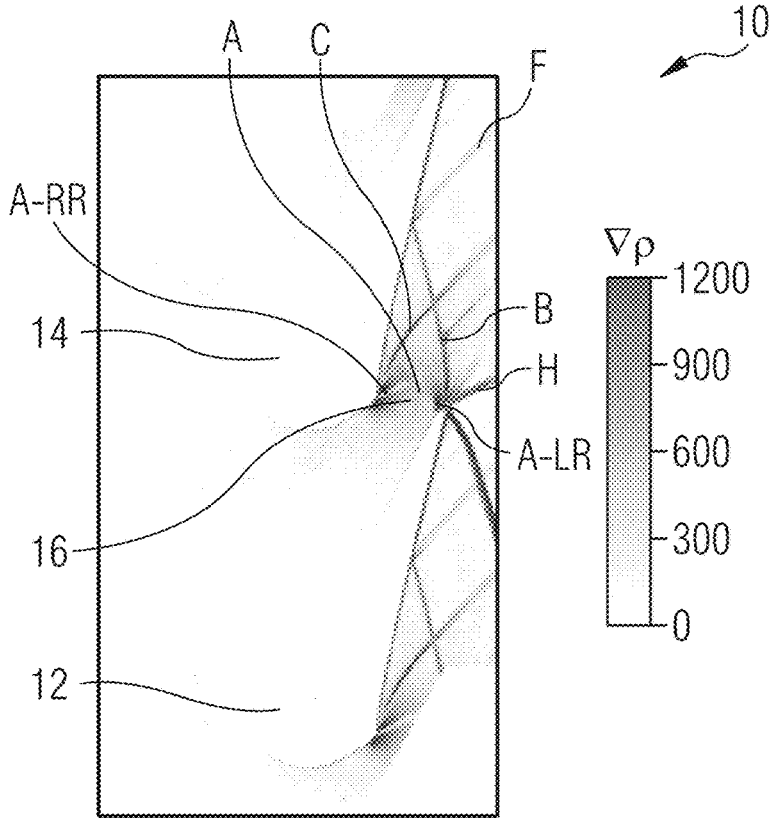
FIG. 2 schematically shows the flow structure in a flow channel defined between two adjacent guide vanes of the guide vane arrangement of FIG. 1 by means of the flow density gradient contours in the flow channel.
Figure 3:
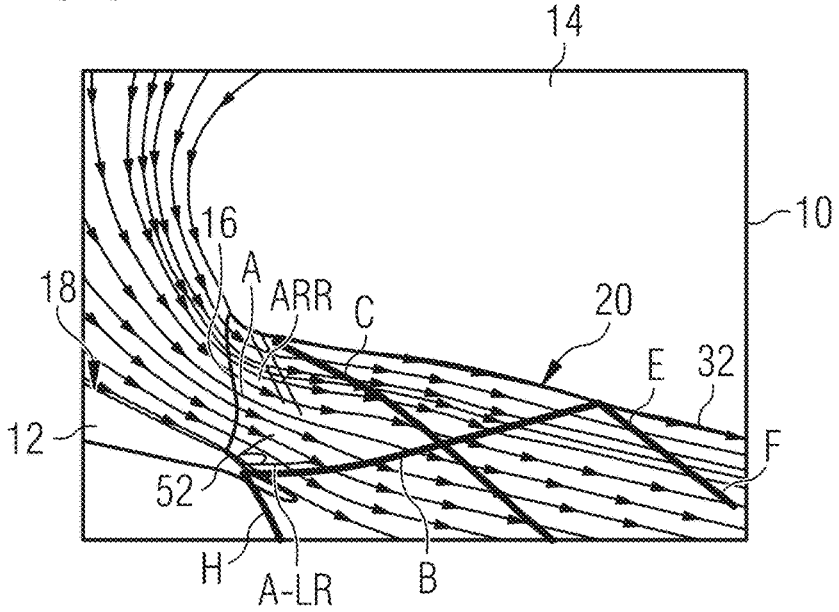
FIG. 3 schematically shows the characteristic fluid flow and the emanating shock and expansion waves of FIG. 2 in an enlarged section of the relevant throat region and upstream trailing portion.

FIG. 2 of the drawings shows the flow density gradient contours of the fluid flow Fin the flow channel 16 between two adjacent first and second guide vanes 12, 14 of the guide vane arrangement 10, and FIG. 3 shows an enlarged section of FIG. 2. In the expansion portion 46 of FIG. 1, a double expansion fan A arises which comprises a right-running leg and a left-running leg, i.e. a right-running expansion wave A-RR and a left-running expansion wave A-LR. The right-running expansion wave A-RR of the double expansion fan A is triggered by the sharp nozzle throat of the second guide vane 14, i.e. the sharp edge in the transition portion 44 between the leading portion 36 and the trailing portion 32 of the trailing surface 20 shown in FIG. 1. The left-running expansion wave A-LR of the double expansion fan A is triggered by the sharp corner 52 of the trailing edge 30 of the leading surface 18 of the first guide vane 12, as shown in FIG. 3.

Figure 4:
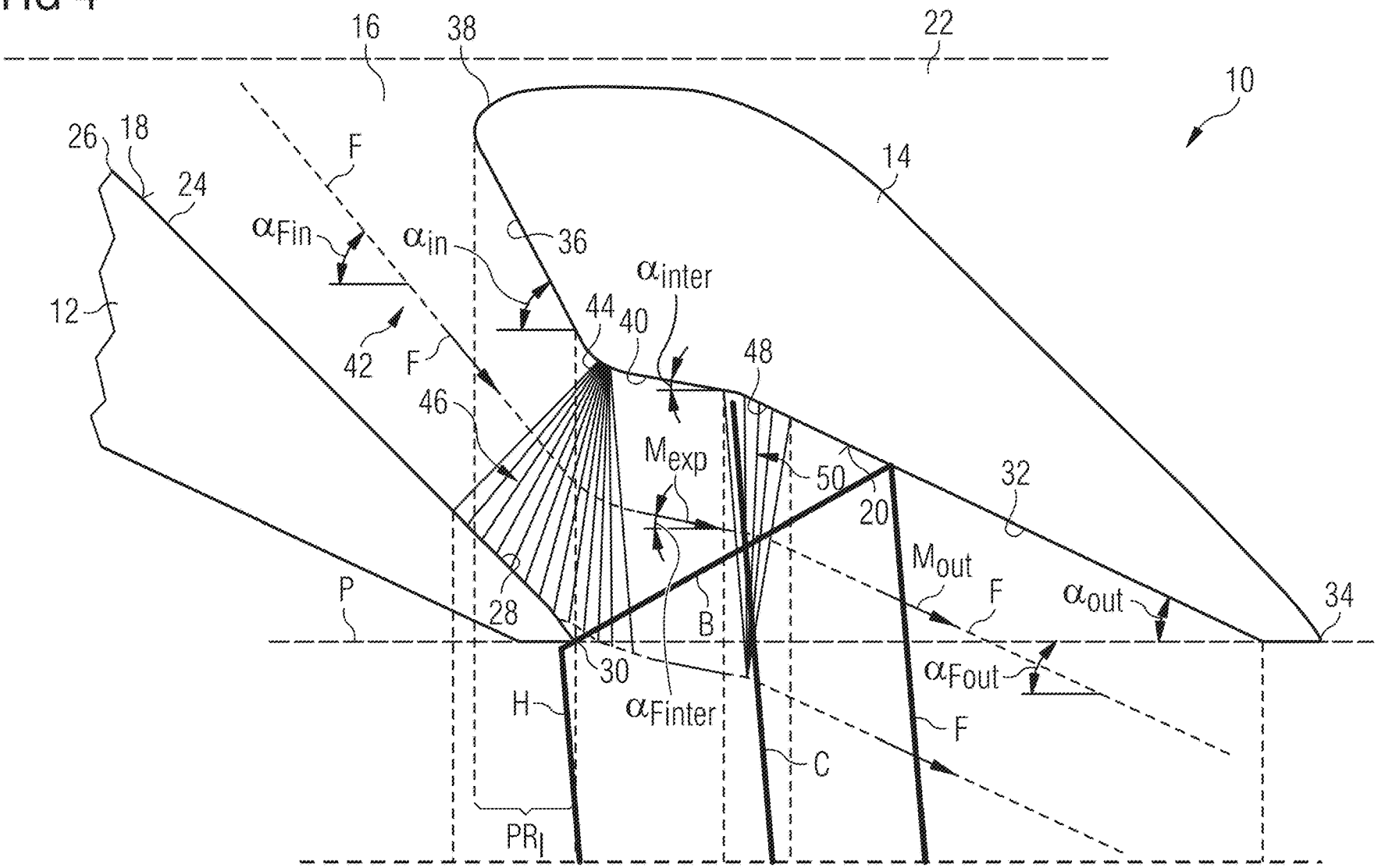
FIG. 4 schematically shows the location of the shock waves in the illustration of the guide vane arrangement of FIG. 1.

Further downstream, the right-running expansion wave A-RR of the double expansion fan A is followed by an oblique shock wave C, which is caused by the flow recompression in the recompression portion 50. The oblique shock wave C, i.e. the recompression shock wave C, redirects the flow away from the wall defined by the trailing surface 20 of the second guide vane 14 and adjusts the flow direction to the wall angle of the trailing portion 32 of the trailing surface 20. The oblique shock wave C is also plotted in the illustration of FIG. 4.

The left-running expansion wave A-LR of the double expansion fan A is followed by a shock wave B. The shock wave B arises from a set of compression waves that coalesce into a strong oblique shock emanating from the trailing edge 30 of the first guide vane 12.

The left-running expansion wave A-LR and the shock wave B impinge on the trailing surface 20 in the trailing portion 32 of the second guide vane 14 and are reflected as a right-running expansion wave E and a shock wave F (cf. FIG. 3).

The reflected right-running expansion wave E and the shock wave F as well as the right-running expansion wave A-RR and the recompression shock wave C travel towards the downstream rotor blades, where the cumulation of these waves causes pressure jumps on the rotor blades.

The present disclosure provides for an optimized guide vane profile that aims at avoiding the arising of shock waves or at least reducing the intensity of arising shock waves. Specifically, the optimized guide vane profile according to the present disclosure has the effect that the shock waves F and C described with respect to the prior art baseline profile do not occur or are at least weakened to a great extent.

Figure 5:
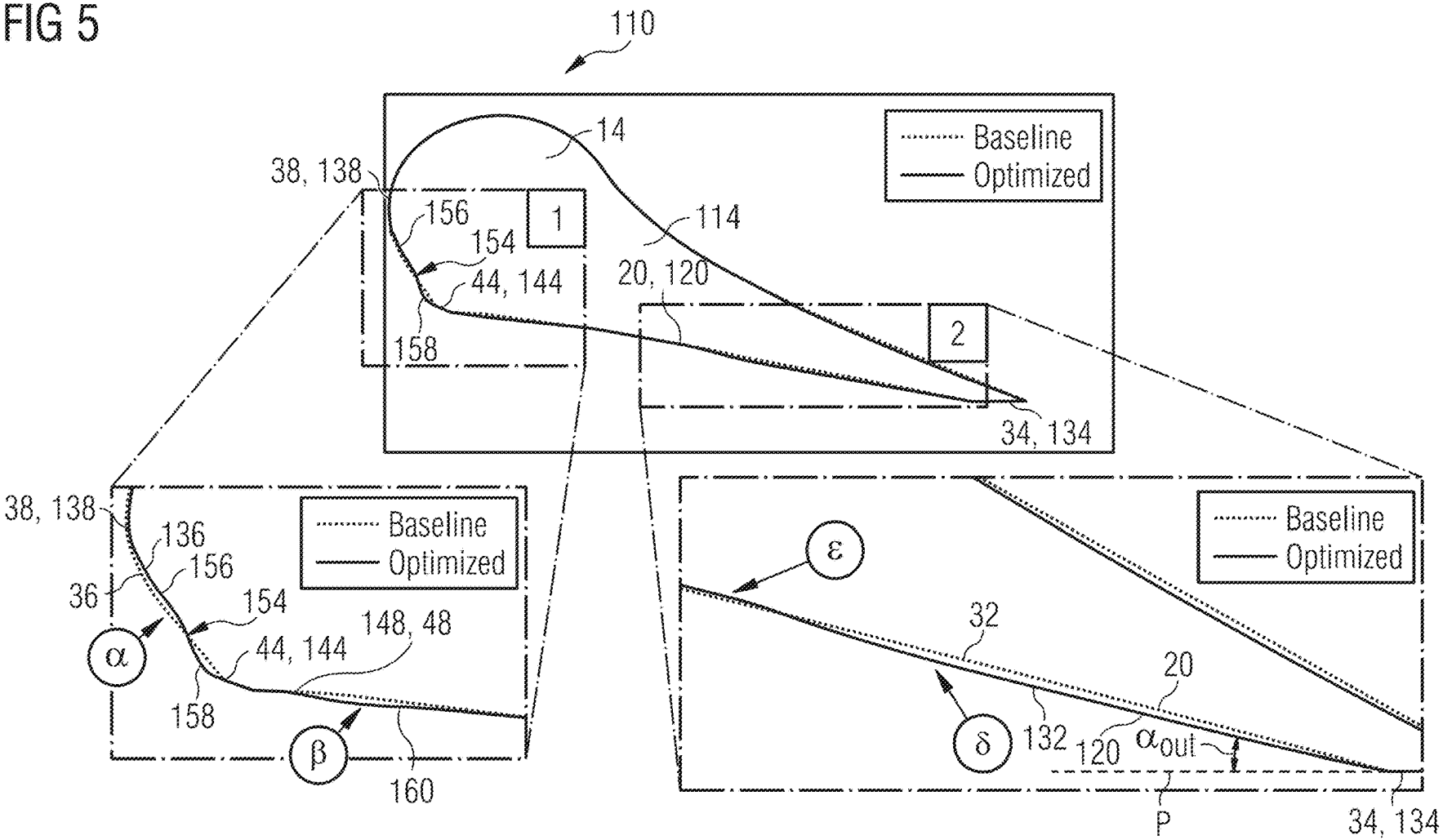
FIG. 5 schematically illustrates an embodiment of the optimized guide vane profile according to the present disclosure compared to the baseline guide vane profile of FIGS. 1, 2, and 4.

FIG. 5 of the drawings shows the optimized guide vane profile in direct comparison with the prior art guide vane profile as discussed with respect to FIGS. 1 to 4. The prior art guideline profile will be named baseline profile in the following. FIG. 5 shows only a single guide vane, which may be any of the plurality of guide vanes of a guide vane arrangement 110. For example, in the present example, the guide vane with the baseline profile may be a second guide vane 114.

A guide vane having the optimized guide vane profile according to the present disclosure and the resulting guide vane arrangement may comprise the same features and characteristics as described above with respect to the first and second guide vanes 12, 14 of the guide vane arrangement 10 according to the prior art embodiment having the baseline profile, with the exception of the differences that will be explicitly described in the following disclosure. Further, same or corresponding features of the guide vane arrangement 110 according to the present disclosure are designated with the same reference numbers increased by 100 as the prior art guide vane arrangement 10.

Figure 6:
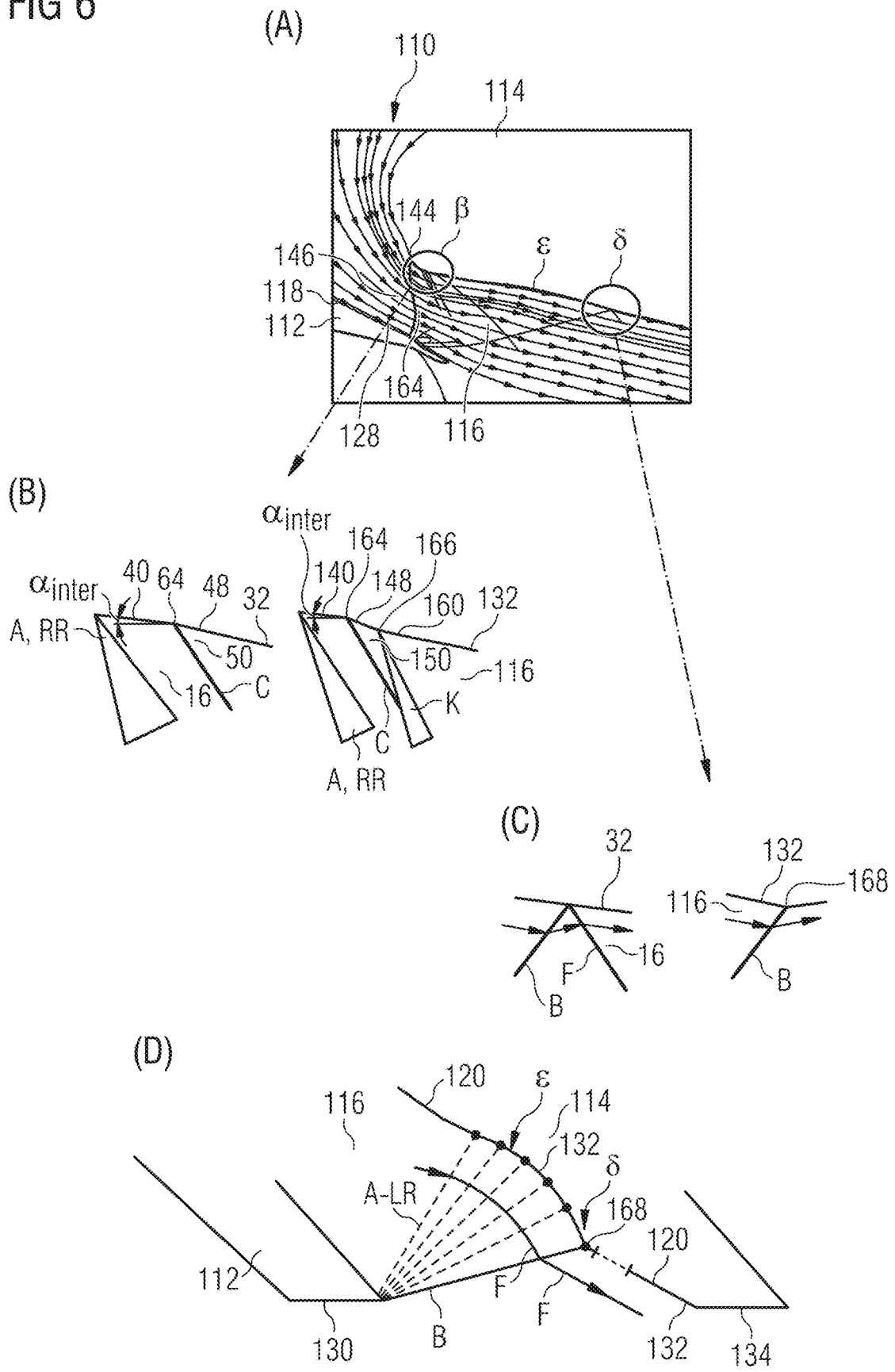
FIGS. 6A to 6D schematically illustrate the working principle of the optimized guide vane profile of the present disclosure.
Figure 7:
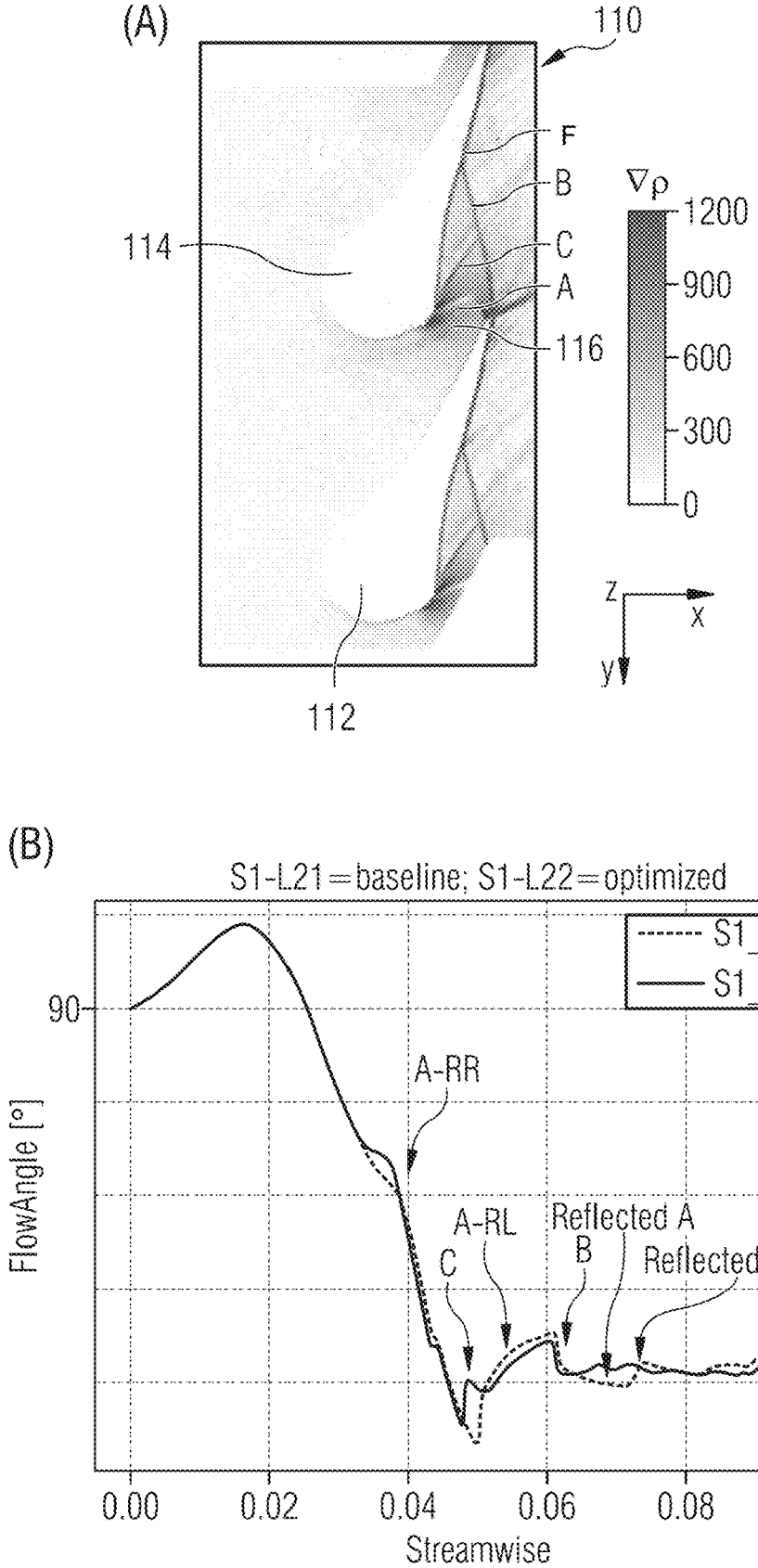
FIG. 7A schematically shows the flow structure in a fluid channel between two adjacent guide vanes having the optimized guide vane profile according to the present disclosure by means of the flow density gradient contours in the channel, and FIG. 7B schematically illustrates the effects of the optimized guide vane profile in direct comparison with the baseline profile by means of the flow angle along a streamline in the flow channel near the trailing surface.

For example, the virtual plane P, although not shown in the guide vane arrangement 110 of FIGS. 5 to 7 according to the present disclosure, is defined analogously to the virtual plane P of the prior art guide vane arrangement 10, i.e. as a virtual plane defined by the trailing edge of the first guide vane and the trailing edge of the second guide vane. As a further example, also the first angle $\alpha_{out}$, the second angle $\alpha_{in}$ and the third angle $\alpha_{inter}$ of the guide vane arrangement 110 according to the present disclosure are analogously defined as the respective same angles of the prior art guide vane arrangement 10, i.e. with respect to the virtual plane. In the case for a non-linear course of the respective trailing surface portion, the respective angle may be an "average" angle of the respective trailing surface portion. In particular, the angle may be defined by a straight line through the two points at the beginning and the end of the respective trailing surface portion, respectively, and the virtual plane.

The optimized guide vane profile of a guide vane 114 according to an embodiment of the present disclosure is characterized by four characteristic profile deviations compared to the baseline profile. FIG. 5 shows the relevant throat region "1" and a supersonic nozzle portion "2" of the trailing surface in an enlarged view, respectively. The throat region "1" has the main function of imposing a transition from subsonic to supersonic flow conditions. The supersonic nozzle portion "2" is characterized by the semi-open expansion that accelerates the flow to the desired first flow speed $M_{out}$ and first flow angle $\alpha_{Fout}$, as described above with respect to FIG. 1.

As discussed above with respect to FIG. 1 and as can also derived from FIG. 5, the leading portion 36 of the trailing surface 20 of the second guide vane 14 having the baseline profile extends at the relatively large second angle $\alpha_{in}$ with respect to the virtual plane P defined by the trailing edges 30, 34 of the first and the second guide vanes 12, 14 and the profile of the leading portion 36 has an approximately linear course. That is, the leading portion 36 of the baseline profile has an approximately constant slope between the leading edge 38 and the second transition portion 44.

In contrast thereto, the profile of the leading portion 136 of the optimized guide vane profile shows an inflection point 154 between a concave-shaped portion 156 and a convex-shaped portion 158, wherein the convex-shaped portion 158 is located downstream the concave-shaped region 156, i.e. nearer to the throat defined by the second transition portion 44 (which corresponds in the optimized profile to a third transition portion 144, as will be described below). The concave shape and the convex shape of the profile is relative to the interior of the respective guide vane 114. The concave-shaped portion 156 is a portion with a surface profile inclined towards the interior of the respective guide vane 114, and the convex-shaped portion is a portion with a surface profile inclined away from the interior of the respective guide vane 114. Or, in other words, the concave-shaped portion 156 is a portion with a surface profile protruding away from the fluid channel 116, and the convex-shaped portion is a portion with a surface profile protruding into the fluid channel 116. The characteristic guide vane profile upstream the throat or third transition portion 144 with a concave-shaped portion 156 and a convex-shaped portion 158 and an inflection point 154 therebetween is labelled characteristic feature "α".

Although not shown, the average second angle $\alpha_{in}$ of the leading portion defined by a straight line through two points at the beginning and the end of the leading portion largely corresponds to the second angle $\alpha_{in}$ of the baseline profile, since the course of the optimized guide vane profile substantially coincides with the course of the baseline profile at the beginning and the end of the leading portion.

The characteristic feature "α" induces that a downstream third transition portion 144 is slightly differently shaped that the corresponding second transition portion 44 of the baseline profile. Nevertheless, the third transition portion 144 has a third convex curvature and defines together with the outlet portion 128 of the leading surface 118 of the first guide vane 112 an expansion portion 146 of the flow channel 116 which has a flow cross-section that increases in the flow direction of the fluid flow flowing through the flow channel 116 (cf. also FIG. 6A).

A further characteristic feature labelled "β" is provided in the throat region "1" downstream the throat. This characteristic feature is provided in a second transition region 160 between the trailing portion 132 and the first transition portion 148 of the trailing surface 120. In the second transition region 160, the optimized profile of the trailing surface 120 according to the present disclosure comprises a first convex curvature labelled "β".

A third characteristic feature labelled "δ" is provided in the supersonic nozzle portion "2" downstream the throat region "1", in the trailing portion 132 of the trailing surface 120. In the baseline profile, the trailing portion 32 of the trailing surface 20 of the second guide vane 14 has a profile with a monotonic course, in particular a monotonic curvature, more particularly a slightly monotonic curvature. In contrast thereto, the optimized profile of the trailing portion 132 of the trailing surface 120 according to the present disclosure has a second convex curvature "S" in the supersonic nozzle portion "2" downstream the throat region "1", as is seen in the enlarged section of the supersonic nozzle portion "2" in FIG. 5. As is also seen in FIG. 5, the surface profiles of the trailing edges 14, 134 of the baseline profile and the optimized profile coincide with each other.

Finally, a fourth characteristic feature labelled with "α" results from the characteristic features "β" and "δ". In particular, since the trailing surface 120 has first and second convex surface curvatures "β" and "δ" in the second transition portion 160 and in the trailing portion 132, an intermediate portion with a concave surface curvature "E" is provided between the two convex-shaped surface portions "β" and "δ". This concave feature also cancels the left-running expansion waves A-LR (emanated from the trailing edge of the first guide vane 112) that impinge on the second guide vane 114 (cf. FIG. 6D).

The first angle $\alpha_{out}$ depicted in FIG. 5 is an average angle defined by a straight line (not shown) through two points at the beginning and the end of the trailing portion 132 and approximately is the same as the corresponding first angle $\alpha_{out}$ of the baseline profile.

In the present embodiment, apart from the described differences, the second guide vane 114 may correspond to the second guide vane 14 of the prior art and may form a guide vane arrangement 110 with an identical first guide vane 112.

The beneficial impact of these four characteristic features on the flow homogeneity and reduction of losses shall be explained in the following, with reference to FIGS. 5 and 6A to 6C of the drawings. In particular, FIGS. 6A to 6C schematically illustrate the working principle of the optimized guide vane profile according to an embodiment of the present disclosure by comparing the flow conditions with those of the guide vane arrangement 10 with the baseline profile.

FIG. 6A shows a guide vane arrangement 110 having the optimized guide vane profile according to an embodiment of the present disclosure, and FIG. 6B (right illustration) is an enlarged view of the throat region of FIG. 6A with feature "β" and FIG. 6C (right illustration) is an enlarged view of the portion of the supersonic nozzle portion of FIG. 6A relevant for feature "δ". The left illustrations of FIG. 6B and FIG. 6C show the respectively corresponding portions of the trailing surface of the baseline profile.

The left illustration of FIG. 6B shows the trailing surface profile of the intermediate portion 40 directly downstream the first transition portion 44 with the throat bump followed by the trailing surface profile of the downstream first transition portion 48 and trailing portion 32. The first transition portion 48 provides a first bend 64 between the intermediate portion 40 and the trailing portion 32 protruding away from the flow channel 16. The first bend 64 may be part of a first concave curvature in the first transition portion 48. FIG. 6B also depicts the shock wave C in the recompression portion 50 defined by the first transition portion 48.

The right illustration of FIG. 6B showing the optimized guide vane profile also comprises the first transition portion 148 having the first bend 164. Furthermore, it additionally shows a second bend 166 of the convex curvature "β" downstream of the first bend 146 in the second transition portion 160, wherein the second bend 166 protrudes into the flow channel 116. The intermediate portion 140 is arranged at the same or approximately same third angle $\alpha_{inter}$ with respect to the virtual plane defined by the trailing edges of the first and second guide vanes 112, 114 as is the intermediate portion 40 of the baseline profile. In an embodiment, the intermediate portion 140 is arranged at a third angle $\alpha_{inter}$ that is slightly smaller than the corresponding angle (inter of the intermediate portion 40 of the baseline profile in order to reduce the expansion from the third transition portion 144.

From the enlarged views of FIG. 6C of the relevant portions of the supersonic nozzle portion, it can be derived that in the optimized profile of the trailing portion 132, compared to the linear or approximately linear course of the trailing surface 20 in the trailing portion 32 of the baseline profile, a third bend 168 of the convex curvature "δ" is provided which protrudes into the flow channel 116.

As seen in and explained with respect to FIG. 5, the characteristic feature "α" upstream of the throat in the throat region features out a more pronounced throat bump, particularly towards the subsonic part of the profile of the trailing surface 120, which effects a "broadening" of the throat bump and advancing the sonic line further upstream compared to the baseline profile. As a consequence, a part of the expansion portion 146 is smoothened out and the right-running expansion fan A-RR is weakened with respect to the baseline profile which leads to smaller flow non-uniformities (cf. FIG. 8) which might have negative impacts on the downstream rotor blades.

The weakened expansion fan A of the optimized surface profile compared to the expansion fan A of the baseline profile can be also derived from FIG. 6B.

Furthermore, the weakened expansion fan A upstream of the recompression shock C leads to a smaller flow turning achieved in the throat (cf. also FIG. 7B) and thus to a weakened intensity of the recompression shock C caused by the flow compression in the recompression portion 150 at or close to the first bend 164. In particular, due to the smaller flow turning, a smaller flow angle change is required to adjust the flow direction to the wall angle of the first transition portion 148 and the trailing portion 132 which finally leads to a weakened shock wave C caused by the recompression portion 150.

In addition, the reduced over-expansion is combined with an attenuated recompression caused by a smaller deflection of the flow downstream of the shock C that results in a shock C that extinguishes or at least strongly attenuates before reaching a downstream rotor.

Furthermore, the characteristic feature "β" provides for a "bump" (second bend 166) protruding into the flow channel 116 due to the convex curvature characteristic for the feature "β". The "bump" re-deflects the flow away from the shock wave C thereby causing an additional expansion fan K that further reduces the shock strength of the shock wave C up to cancellation in the far field. The additional expansion fan K downstream the shock wave C is also depicted in the flow conditions of the optimized profile of FIG. 6B. It is also schematically shown that the additional expansion fan K cancels the shock wave C in the far field. Thus, the second transition region 160 defines an additional second expansion portion of the flow channel.

Hence, the characteristic feature "β" rearranges the expansion-compression design of the prior art baseline profile into an expansion-compression-expansion design. The resulting benefit is a reduction of the strength of the shock wave C until a cancellation in the far field. This improves the homogeneity of the flow and reduces mixing losses (driven by the viscous dissipation occurring in the shock).

The baseline profile did not account for the impact of the trailing edge shock B on the supersonic part of the nozzle. The characteristic feature "δ" guides the supersonic flow in the supersonic nozzle portion "2" in such a way that the flow direction remains parallel to the wall defined by the trailing portion 132. This is achieved as described in the following. In the guide vane arrangement 10 with the baseline profile, the shock wave B emanating from the trailing edge 30 of the first guide vane 12 redirects the flow towards the wall defined by the trailing portion 32. The redirection compresses the flow and causes a reflected shock wave F to appear adjusting the flow direction to the wall angle (cf. left illustration of FIG. 6C). The convex curvature with the "bump" (third bend 168) of characteristic feature "δ" accommodates for this flow deflection by the shock wave B, making sure that the flow remains parallel to the wall contour downstream of the shock wave B defined by the trailing portion 132, thereby avoiding or at least strongly attenuating the appearance of the reflected shock wave F.

Thus, the characteristic feature "δ" has the benefit of avoiding the additional recompression by the reflected shock wave F, improving the flow homogeneity and reducing mixing losses (driven by the viscous dissipation occurring in the reflected shock F).

Finally, in the guide vane arrangement 10 with the baseline profile, the left-running expansion waves LR of the expansion fan A emanated by the trailing edge corner 52 of the trailing edge 30 of the opposed leading surface 18 of the first guiding vane 12 (which is an opposed guiding vane forming the fluid channel with the second guiding vane 14) impinge on the trailing surface 20 in the trailing portion 32 of the second guide vane and are reflected as expansion waves E. These waves travel downstream and affect the flow homogeneity at the outlet of the guide vane arrangement and subsequent rotor blades. The characteristic feature "ε" featuring the second concave curvature cancel the incoming left-running expansion waves A-LR thereby guaranteeing that the flow angle after a wave is parallel to the wall contour downstream of that wave. This is schematically illustrated in FIG. 6D of the drawings. This contributes to the smoothing of the outlet flow field.

The trailing surface 120 of the guide vane arrangement 110 may also be designed with a gradual non-linear curve extending along the whole length of the trailing surface 120 between the second transition portion 144 and the trailing edge 134. In that case, the intermediate portion 140 will collapse to a point, and the angle (inter defines the wall inclination at the start of the first transition portion 148.

Summarizing, the combination of the characteristic features "α", "β" and "δ" attenuates the occurrence of shock waves traveling outward into the far field of the guide vane arrangement 110. The feature "ε" cancels the reflection of expansion waves traveling out into the far field of the guide vane arrangement 110. This improves the homogeneity of the flow field at the outlet of the guide vane arrangement, before it reaches the rotor. Furthermore, the attenuation of the shocks also reduces viscous and mixing losses, improving the performance of the nozzle.

FIG. 7A shows a Computational Fluid Dynamics (CFD) simulation of the density gradient contours in the flow channel 116 of the optimized guide vane arrangement 110 according to the present disclosure. Compared to the CFD simulation of the baseline profile in FIG. 2, the recompression shock wave C is weaker and almost disappeared in the far field, and the reflected shock wave F has also almost disappeared.

FIG. 7B shows simulation data of the flow angle (i.e. the angle from the axial direction, i.e. a virtual line orthogonal to "P" on FIG. 1) in dependence upon the streamwise (stream direction) of the flow through the flow channel. It can be seen that the weakened expansion fan A upstream of the recompression shock C leads to a smaller flow turning achieved in the throat. It can be further seen that the flow substantially remains parallel to the wall contour downstream of the shock wave B, i.e. no or only a small flow turning, due to the reflected shock wave F not appearing or at least being weakened due to the convex curvature with the "bump" (third bend 168) of characteristic feature "δ". Finally, also additional flow turning due to reflections of the incoming left-running expansion waves A-LR is avoided or at least weakened due to the characteristic feature "E", as is also seen in FIG. 7B.

Figure 8:
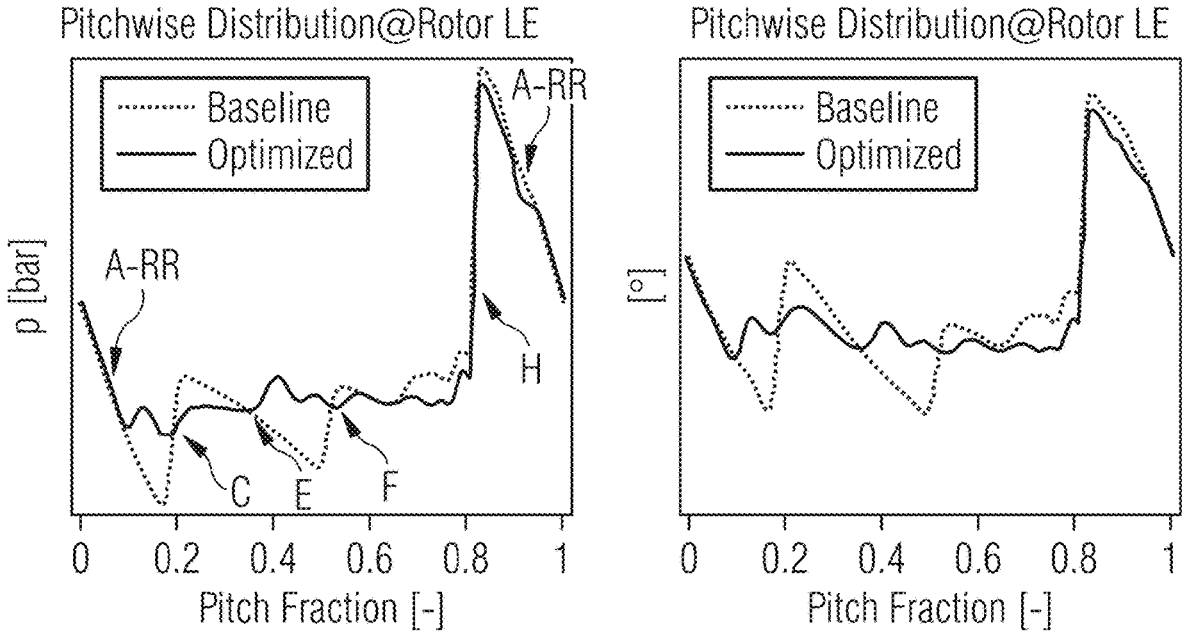
FIG. 8 shows two diagrams comparing the static pressure distribution in the pitchwise direction, evaluated exemplarily at the axial location corresponding to the rotor leading edge (LE) plane, when using a baseline guide vane profile and an optimized guide vane profile.

FIG. 8 shows a comparison of the normalized static pressure distribution in the pitchwise direction, evaluated at the axial location corresponding to the rotor LE plane, when using a baseline guide vane profile and an optimized guide vane profile. The normalized static pressure distribution is based on simulation data. The pitchwise distribution of the baseline design is affected by wide and sharp fluctuations caused by the above-described expansion fans and shock waves. More precisely, moving from lower to higher pitch fraction values, the first decreasing trend between 0 and 0.2 is ascribed to the RR leg of the expansion fan A. Subsequently, a rapid pressure rise appears about pitch fraction 0.2 as a consequence of the oblique recompression shock wave C. The latter is followed by a decreasing trend (between 0.2 and 0.5) due to the reflected expansion fan E, followed by a steep increase due to the trace of the reflected shock F. Finally, about 0.8 pitch fraction, a particularly sudden pressure rise occurs due to the strong oblique shock wave H, followed by a decreasing trend, that can be ascribed to the first part of the RR branch of expansion fan A. Furthermore, this pattern also affects the pitchwise distributions of other quantities not depicted here, such as the outlet speed and outlet flow angle.

The static pressure distribution is substantially smoother when using a guide vane arrangement 110 with the optimized guide vane profile according to the present disclosure. Pressure jumps caused by the shock waves "F" and "C" and the expansion waves "E" could be removed or at least weakened.

The guide vane arrangement 110 according to the present disclosure with the optimized guide vane profile has the effect of weakening and/or avoiding shock waves at the exit of the guide vane arrangement. This leads to a reduced dynamic load at a downstream rotor, thereby enhancing the life time of the rotor. Furthermore, a reduction of flow losses may be achieved, which may lead to an enhanced efficiency of a turbine or turbo pump comprising the guide vane arrangement. At the same time, the guide vane arrangement may be produced in a cost-effective manner, for example by means of an additive manufacturing process, and thus provides the same advantages with regard to the manufacturing process as the guide vane arrangement known from EP 3 569 817 A.

What is claimed:

1. A guide vane arrangement, in particular for use in a turbo pump, which comprises:

a first guide vane, and a second guide vane, wherein the second guide vane is arranged adjacent to the first guide vane such that a flow channel is defined between a leading surface of the first guide vane and a trailing surface of the second guide vane, wherein the flow channel is designed in such a manner that the fluid flow, when exiting the flow channel, flows at a desired first flow speed, wherein the trailing surface of the second guide vane comprises a trailing portion which is arranged adjacent to a trailing edge of the second guide vane and which is arranged at a first angle with respect to a virtual plane defined by a trailing edge of the first guide vane and the trailing edge of the second guide vane, a leading portion which is arranged adjacent to a leading edge of the second guide vane and which is arranged at a second angle with respect to the virtual plane defined by the trailing edge of the first guide vane and the trailing edge of the second guide vane, and an intermediate portion which is arranged between the trailing portion and the leading portion and which is arranged at a third angle with respect to the virtual plane defined by the trailing edge of the first guide vane and the trailing edge of the second guide vane, wherein the second angle is larger than each of the first and third angles, and wherein the trailing surface between the intermediate portion and the trailing edge comprises at least one portion having a convex curvature.

2. The guide vane arrangement of claim 1, wherein the trailing surface of the second guide vane comprises a first transition portion between the intermediate portion and the trailing portion which defines a recompression portion of the flow channel which has a flow cross-section that decreases in the flow direction of the fluid flow flowing through the flow channel, and wherein the recompression portion is designed in such a manner that the fluid flow, upon flowing through the recompression portion, is decelerated to a second flow speed.

3. The guide vane arrangement of claim 2, wherein the first transition portion comprises a first concave curvature.

4. The guide vane arrangement of claim 1, wherein the trailing surface of the second guide vane comprises a second transition portion between the intermediate portion and the trailing portion which comprises a first convex curvature, wherein the second transition portion defines an additional expansion portion of the flow channel which has a flow cross-section that increases in the flow direction of the fluid flow flowing through the flow channel, and wherein the additional expansion portion is designed in such a manner that the fluid flow, upon flowing through the additional expansion portion, is accelerated to a third flow speed.

5. The guide vane arrangement of claim 4, wherein the trailing surface of the second guide vane comprises a first transition portion between the intermediate portion and the trailing portion which defines a recompression portion of the flow channel which has a flow cross-section that decreases in the flow direction of the fluid flow flowing through the flow channel, and wherein the recompression portion is designed in such a manner that the fluid flow, upon flowing through the recompression portion, is decelerated to a second flow speed, and wherein the first transition portion is arranged between the intermediate portion and the second transition portion.

6. The guide vane arrangement of claim 5, wherein the third flow speed approximately corresponds to the desired first flow speed and/or is higher than the second flow speed.

7. The guide vane arrangement of claim 5, wherein the first transition portion comprises a first concave curvature.

8. The guide vane arrangement of claim 1, wherein the trailing portion of the trailing surface of the second guide vane comprises a second convex curvature.

9. The guide vane arrangement of claim 8, wherein the trailing surface of the second guide vane comprises a second transition portion between the intermediate portion and the trailing portion which comprises a first convex curvature, wherein the second transition portion defines an additional expansion portion of the flow channel which has a flow cross-section that increases in the flow direction of the fluid flow flowing through the flow channel, and wherein the additional expansion portion is designed in such a manner that the fluid flow, upon flowing through the additional expansion portion, is accelerated to a third flow speed, and wherein the trailing portion of the trailing surface of the second guide vane comprises a second concave curvature between the first and second convex curvatures.

10. The guide vane arrangement of claim 1, wherein the leading portion of the second guide vane has a leading portion curvature with an inflection point where a concave curvature of a concave-shaped portion passes over in a convex curvature of a convex-shaped portion, and wherein the concave-shaped portion is provided upstream of the convex-shaped portion.

11. The guide vane arrangement of claim 1, wherein the trailing surface of the second guide vane comprises a third transition portion between the leading portion and the intermediate portion, wherein the third transition portion comprises a third convex curvature, and wherein the third transition portion and the outlet portion of the leading surface of the first guide vane define an expansion portion of the flow channel which has a flow cross-section that increases in the flow direction of the fluid flow flowing through the flow channel, and wherein the expansion portion is designed in such a manner that the fluid flow, upon flowing through the expansion portion, is accelerated to a fourth flow speed.

12. The guide vane arrangement of claim 1, wherein the third angle of the intermediate portion is smaller than the first angle of the trailing portion.

13. The guide vane arrangement of claim 1, wherein the leading surface of the first guide vane comprises at least one of:

an inlet portion which is arranged adjacent to a leading edge of the first guide vane and which, with respect to the flow channel, is arranged opposite to the leading portion of the trailing surface of the second guide vane, wherein the inlet portion of the leading surface of the first guide vane and the leading portion of the trailing surface of the second guide vane define a restricting portion of the flow channel which has a flow cross-section that decreases in a flow direction of the fluid flow flowing through the flow channel, and an outlet portion which is arranged adjacent to a trailing edge of the first guide vane, wherein a projection of the leading portion of the trailing surface of the second guide vane into the virtual plane at least partially coincides with a projection of the outlet portion of the leading surface of the first guide vane into the virtual plane.

14. The guide vane arrangement of claim 13, wherein a projection of the intermediate portion and/or of the first transition portion and/or of second transition portion and/or of the trailing portion of the trailing surface of the second guide vane into the virtual plane does not coincide with the projection of outlet portion of the leading surface of the first guide vane into the virtual plane.

15. A turbine, in particular for use in a turbo pump, comprising the guide vane arrangement of claim 1.

16. A method of operating a guide vane arrangement, comprising:

supplying a fluid flow to a flow channel defined between a leading surface of a first guide vane and a trailing surface of a second guide vane, and guiding the fluid flow along a trailing portion of the trailing surface of the second guide vane which is arranged adjacent to a trailing edge of the second guide vane and thereby deflecting the fluid flow such that the fluid flow exits the flow channel at a first flow angle with respect to a virtual plane defined by a trailing edge of the first guide vane and the trailing edge of the second guide vane and with a desired first flow speed, wherein the fluid flow, prior to being guided along the trailing portion of the trailing surface, is guided along a leading portion of the trailing surface of the second guide vane which is arranged adjacent to a leading edge of the second guide vane and thereby deflected such that the fluid flow flows at a second flow angle with respect to the virtual plane defined by the trailing edge of the first guide vane and the trailing edge of the second guide vane, and thereafter is guided along an intermediate portion of the trailing surface of the second guide vane which is arranged between the trailing portion and the leading portion and thereby deflected such that the fluid flow flows at a third flow angle with respect to the virtual plane defined by the trailing edge of the first guide vane and the trailing edge of the second guide vane, wherein the second flow angle is larger than each of the third flow angle and the first flow angle, and thereafter is guided along a first transition portion of the trailing surface of the second guide vane which is arranged between the intermediate portion and the trailing portion and which defines a recompression portion of the flow channel which has a flow cross-section that decreases in the flow direction of the fluid flow flowing through the flow channel, and wherein the recompression portion is designed in such a manner that the fluid flow, upon flowing through the recompression portion, is decelerated to a second flow speed, and thereafter is guided along a second transition portion of the trailing surface of the second guide vane which is arranged between the first transition portion and the trailing portion and which defines an additional expansion portion of the flow channel which has a flow cross-section that increases in the flow direction of the fluid flow flowing through the flow channel, and wherein the additional expansion portion is designed in such a manner that the fluid flow, upon flowing through the expansion portion, is accelerated to a third flow speed.

17. The method of claim 16, wherein the fluid flow, prior to being guided along the trailing portion of the trailing surface, is guided along a third transition portion of the trailing surface of the second guide vane which is arranged between the leading portion and the intermediate portion, wherein the third transition portion and an outlet portion of the leading surface of the first guide vane define an expansion portion of the flow channel which has a flow cross-section that increases in the flow direction of the fluid flow flowing through the flow channel, and wherein the expansion portion is designed in such a manner that the fluid flow, upon flowing through the expansion portion, is accelerated to a fourth flow speed.

18. The method of claim 17, wherein the fourth flow speed is higher than the desired first flow speed.

19. The method of claim 16, comprising at least one of the following:

the first transition portion of the trailing surface of the second guide vane comprises a first concave curvature, the second transition portion of the trailing surface of the second guide vane comprises a first convex curvature, the trailing portion of the trailing surface of the second guide vane comprises a second convex curvature, the third transition portion of the trailing surface of the second guide vane comprises a third convex curvature, the trailing portion of the trailing surface of the second guide vane comprises a second concave curvature between the first and second convex curvatures, and the leading portion comprises a leading portion curvature with an inflection point where a concave curvature of a concave-shaped portion passes over in a convex curvature of a convex-shaped portion, wherein the concave-shaped portion is provided upstream the convex-shaped portion.

20. The method of claim 16, wherein the third flow speed approximately corresponds to the desired first flow speed.

* * * * *